US012780485B2

(12) United States Patent
Håkansson et al.

(10) Patent No.: US 12,780,485 B2
(45) Date of Patent: Nov. 3, 2026

(54) BLANK, A CARTON GABLE TOP PACKAGE AND A METHOD FOR PRODUCING A CARTON GABLE TOP PACKAGE

(71) Applicant: Tetra Laval Holdings & Finance S.A., Pully (CH)

(72) Inventors: Bengt Håkansson, Sjöbo (SE); Göran Dahl, Höör (SE); Erica Lundström, Malmö (SE); Ida Leufstedt, Lomma (SE); Kristian Jacobsson, Dalby (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 18/578,386

(22) PCT Filed: Jul. 7, 2022

(86) PCT No.: PCT/EP2022/068952
§ 371 (c)(1),
(2) Date: Jan. 11, 2024

(87) PCT Pub. No.: WO2023/285289
PCT Pub. Date: Jan. 19, 2023

(65) Prior Publication Data

US 2024/0294298 A1 Sep. 5, 2024

(30) Foreign Application Priority Data

Jul. 15, 2021 (EP) ..... 21185882

(51) Int. Cl.
*B65D 5/06* (2006.01)
*B65D 5/44* (2006.01)
*B65D 5/56* (2006.01)

(52) U.S. Cl.
CPC ..... *B65D 5/067* (2013.01); *B65D 5/445* (2013.01); *B65D 5/56* (2013.01)

(58) Field of Classification Search
CPC ..... B65D 5/067; B65D 5/445; B65D 5/56; B65D 5/068; B65D 5/746
(Continued)

(56) References Cited

U.S. PATENT DOCUMENTS 4,011,800 A * 3/1977 Walke, Jr. ..... B29C 66/80 493/470
4,712,727 A * 12/1987 Wyberg ..... B65D 5/067 229/137
(Continued)

FOREIGN PATENT DOCUMENTS

JP H08113233 A 5/1996
JP 2000025751 A 1/2000
(Continued)

OTHER PUBLICATIONS

Extended European Search Report dated Nov. 11, 2021, for European Patent Application No. 21185882.4.
(Continued)

*Primary Examiner* — Christopher R Demeree
(74) *Attorney, Agent, or Firm* — Renner, Otto, Boisselle & Sklar, LLP

(57) ABSTRACT

A blank configured to be folded into a gable top package that holds a food product and is openable by forming a spout for the package. The blank comprising first and second gable panels, first and second top fin panels and first and second gable fin panels. The first gable fin panel comprises a spout top crease that separates the first gable fin panel into a spout top portion and a spout reinforcement portion that is configured to be folded, along the spout top crease, over the spout top portion, wherein the spout reinforcement portion is arranged with a distance from the respective first and second top fin panels.

15 Claims, 6 Drawing Sheets

(58) Field of Classification Search
USPC ..... 229/249, 125.42, 137, 246, 5.84, 214, 229/248, 213, 216; 206/524.1; 428/34.2
See application file for complete search history.

(56) References Cited

U.S. PATENT DOCUMENTS 4,756,426 A * 7/1988 Wyberg ..... B65D 5/068 229/125.42
4,762,234 A * 8/1988 Wyberg ..... B65D 5/068 229/249
4,775,096 A * 10/1988 Andersson ..... C09J 101/286 229/125.42
4,792,048 A * 12/1988 Wyberg ..... B65D 5/068 229/125.42
4,946,041 A * 8/1990 Poole ..... B29C 66/81427 229/125.42
5,242,701 A * 9/1993 Poole ..... B29C 66/72328 229/125.42
6,253,994 B1 * 7/2001 Mogard ..... B29C 66/53247 229/209

FOREIGN PATENT DOCUMENTS

JP 2002173133 A 6/2002
JP 2002264937 A 9/2002
KR 200204263 Y1 11/2000
KR 20040106827 A 12/2004

OTHER PUBLICATIONS

International Search Report mailed Oct. 12, 2022, for International Patent Application No. PCT/EP2022/068952.

* cited by examiner

BLANK, A CARTON GABLE TOP PACKAGE AND A METHOD FOR PRODUCING A CARTON GABLE TOP PACKAGE

TECHNICAL FIELD

The invention generally relates to food packages. More particularly, it is related to gable top packages, blanks to be formed into gable top packages, and methods related to the blanks, where the blanks are formed from a multilayer packaging material that comprises a layer of fibrous material.

BACKGROUND ART

A gable top package is a well-known type of package often used for milk and other liquid food products. The package is easily recognized by that it has a top fin and two slanted top panels on each side of the top fin. When opening the package, the top fin is separated in one end. When the top fin is separated, two top fin parts are formed. These are folded down onto the two top panels such that a front (first) gable panel can be folded out, thereby forming a spout such that the liquid food product can be poured from the package. In addition to being user intuitive, an advantage with this type of opening is that no plastic material is needed in form of, for example, a cap, which reduces the environmental impact.

Even though the gable top package has been used by consumers worldwide for decades, there is room for improvement. For instance, a challenge with gable top packages, particularly carton gable top packages, is that they should be made to hold the liquid food product securely and not be opened unintentionally at the same time as they should be easy to open for consumers. Still a challenge is that after the package has been opened, the package should be able to withstand exposure from the liquid food product.

Different measures have been made to overcome these challenges. For instance, by using an asymmetrical welding pattern when forming the top fin, it is made easier to open for the consumer in one of the ends of the top fin, which as an effect provides for increased package integrity and less risk of unintentional opening of the package. However, despite the asymmetric welding patterns on the top fin as well as other measures taken, the spout of the gable top packages can still be improved in terms of package integrity, user interaction and food product interaction.

SUMMARY

It is an object of the invention to at least partly overcome one or more of the above-identified limitations of the prior art. In particular, it is an object to provide a gable top package with properties to better withstand impact caused by the liquid food product. It is also an object to provide a gable top package with improved package integrity, that is, reduced risk of cracks or other unwanted stress in the packaging material. Still an object is to provide a carton gable top package that can be produced from thinner packaging material, thereby improving cost efficiency and environmental impact.

According to a first aspect it is provided a blank configured to be folded into a gable top package that holds a food product and is openable by forming a spout for the package, the blank being formed from a multilayer packaging material that comprises a layer of fibrous material, and comprising bottom panels, sidewall panels, first and second top panels, first and second gable panels, first and second top fin panels and first and second gable fin panels. The first gable fin panel being located between the first and second top fin panels and arranged to form a top section of the spout for the folded gable top package. The first gable fin panel comprises a spout top crease that separates the first gable fin panel into a spout top portion and a spout reinforcement portion that is configured to be folded, along the spout top crease, over the spout top portion, and the spout reinforcement portion is arranged with a distance from the respective first and second top fin panels.

An advantage of having the spout reinforcement portion is that this allows for that the food product can be poured from the package without coming into contact with the layer of fibrous material. More particularly, compared to the commonly used gable top package of today, there is no raw edge exposed to the food product when pouring the product.

Another advantage is that the reinforcement portion provides for that the spout becomes sturdier compared to the gable top packages used today, which provides for improved user experience and handling of the package.

Still an advantage is that by having the distance, that is, having the spout reinforcement portion not extending all along the first gable fin panel, the package can be closed more securely compared to having no distance.

The distance may be greater than three times the thickness of the multilayer packaging material the blank is formed from.

The spout reinforcement portion may comprise first and second inclined sides that are located at opposite ends of the spout reinforcement portion, the first inclined side facing the first top fin front section, the second inclined side facing the second top fin front section, and the inclined sides being inclined relative a direction that is parallel to crease lines of the blank that separate the sidewall panels from each other.

Having the inclined sides, exposure of the raw edge can be reduced at the same time as less material is placed closed to the crease lines between the first top fin panel and the first gable fin panel, and the second top fin panel and the first gable fin panel, respectively.

The first and second inclined sides may be inclined with an inclination angle that is within the range of 20 to 60 degrees.

The spout reinforcement portion may comprise rounded corners that are located at opposite ends of the spout reinforcement portion, wherein the rounded corners face a respective one of the first and second top fin front sections.

A height of the spout reinforcement portion may be within the range of 60-85% of a height of the spout top portion.

The spout reinforcement portion may be welded to the spout top portion.

The spout reinforcement portion may be provided with a lacquer.

According to a second aspect, it is provided a carton gable top package produced from the blank according to the first aspect. The gable top package has the same advantages as the blank.

According to a third aspect it is provided a method for producing a carton gable top package from a blank according to the first aspect. The method comprises: folding down, along the spout top crease, the spout reinforcement portion over the spout top portion; forming a sleeve-shape body by welding a sidewall seal panel of the blank to a first sidewall panel of the blank; forming a bottom by welding bottom panels of the blank, such that the blank forms a container; filling food product into the container; and forming a top fin by welding the first top fin panel to the second top fin panel while the spout reinforcement portion is folded over the spout top portion, for closing the container and form the carton gable top package.

Further objectives, features, aspects and advantages of the invention will appear from the following detailed description as well as from the drawings.

BRIEF DESCRIPTION OF THE DRAWINGS

Embodiments of the invention will now be described, by way of example, with reference to the accompanying schematic drawings, in which.

DETAILED DESCRIPTION

Figure 1A:
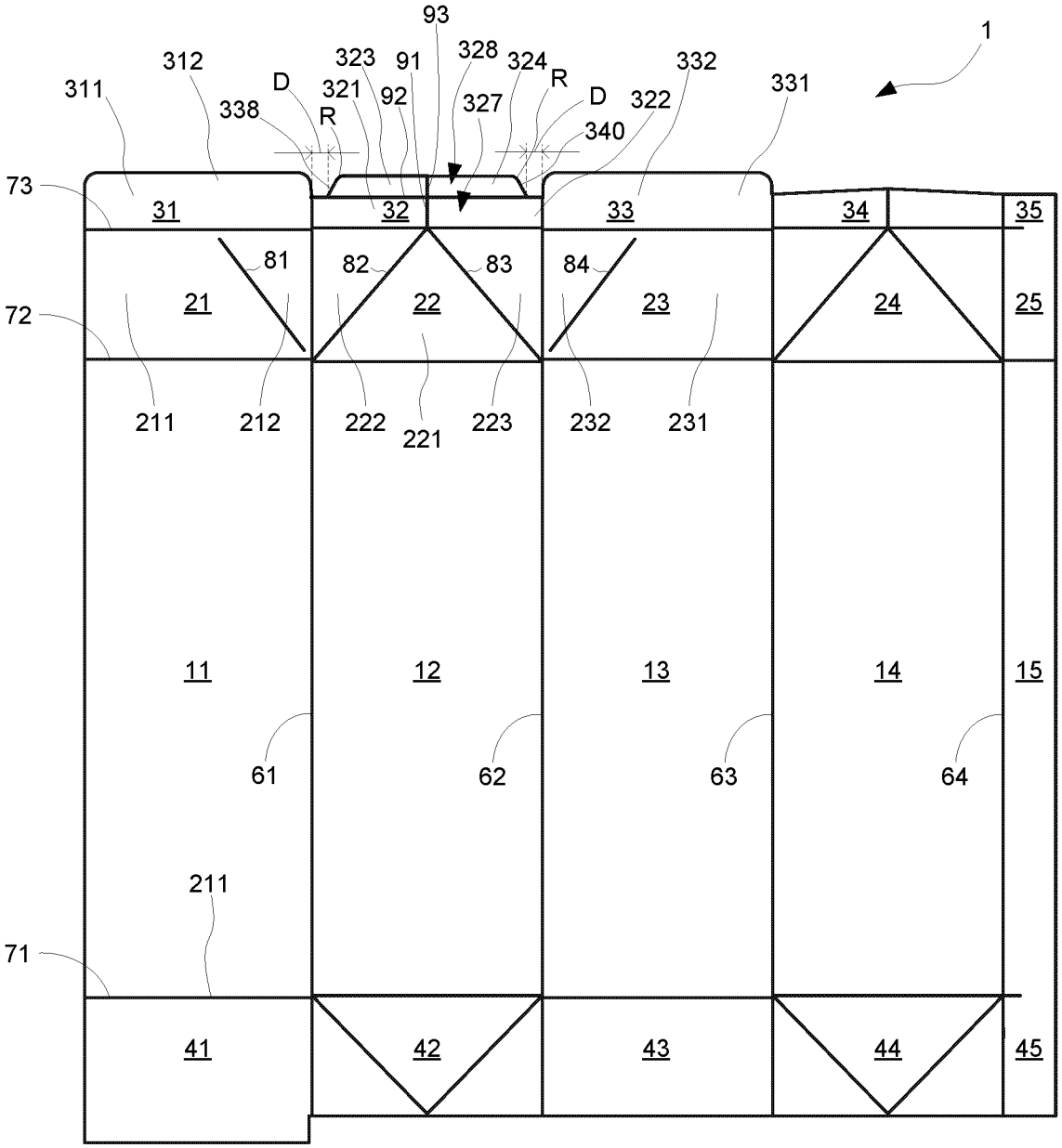
FIG. 1A illustrates a blank provided with a spout reinforcement section.
Figure 2A:
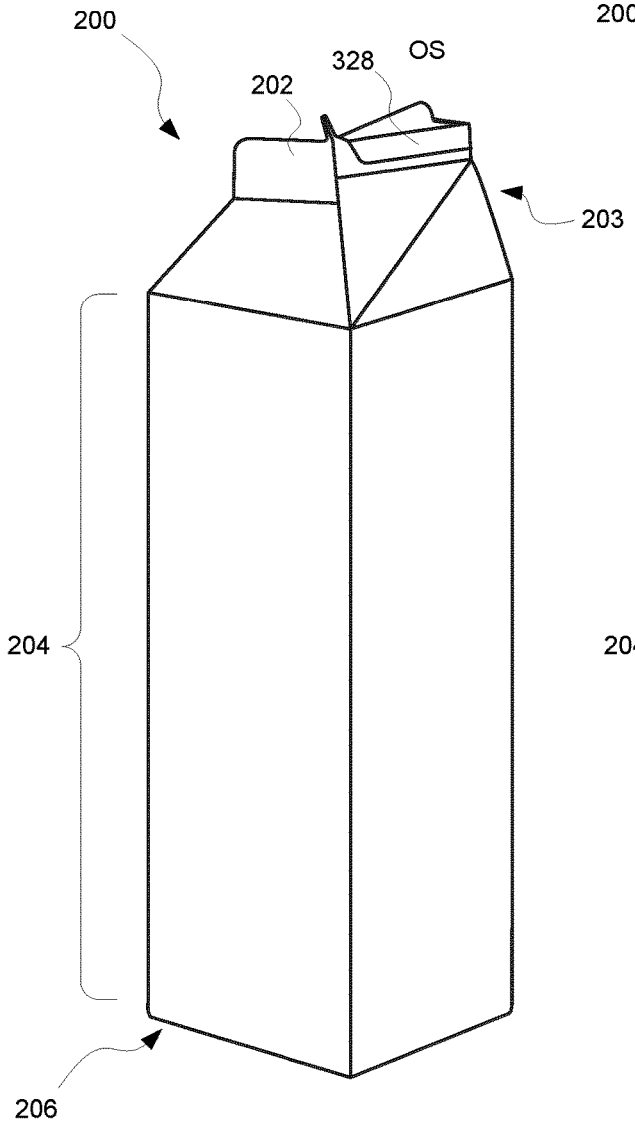
FIG. 2A is a perspective view of a gable top package formed from the blank.
Figure 2B:
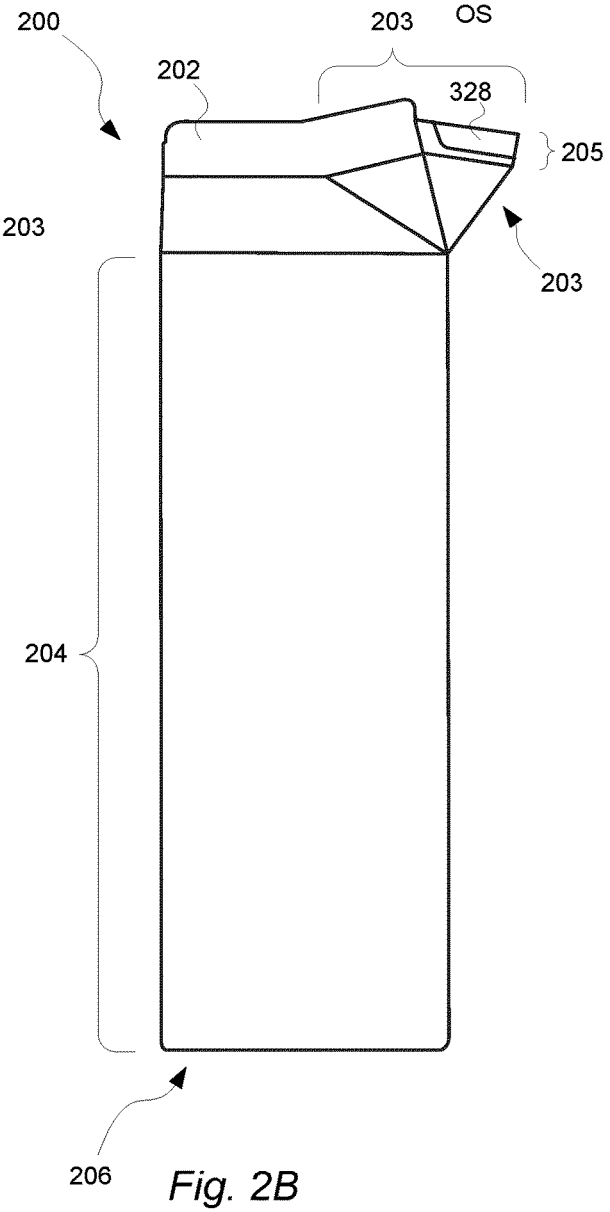
FIG. 2B is a side view of the gable top package.

FIG. 1A illustrates by way of example a blank 1 arranged to be folded into a gable top package 200, illustrated in FIGS. 2A and 2B. As shown, the blank 1 has a first sidewall panel 11, a front wall panel 12, a second sidewall panel 13 and a rear wall panel 14. A longitudinal sealing can be provided by using a sidewall seal panel 15. More particularly, by placing the sidewall seal panel 15 under the first sidewall panel 11 and welding, sometimes also referred to as sealing, the two together the first sidewall panel 11 can be joined with the rear wall panel 14. Even though it is a common approach to join the first sidewall panel 11 with the rear wall panel 14 since this will not interfere with the forming of the spout, other approaches than the one illustrated can also be used. The sealing is per se done according to known principles and techniques that are suitable for the material the blank 1 is made of.

To form a top of the package 200, a first (left) top panel 21, a first (front) gable top panel 22, a second (right) top panel 23 and a second (rear) gable panel 24 are provided. A top seal panel 25 is provided such that the first top panel 21 and the second gable panel 24 can be joined.

To form a top fin 202 of the package 200, as illustrated in FIGS. 2A and 2B, a first top fin panel 31, a first gable fin panel 32, a second top fin panel 33 and a second gable fin panel 34 are provided as illustrated. A fin seal panel 35 is provided such that the first top fin panel 31 can be joined with the second gable fin panel 34.

To form a bottom 206 of the package 200, see FIGS. 2A and 2B, a first bottom panel 41, a second bottom panel 42, a third bottom panel 43 and a fourth bottom panel 44 are provided. A bottom seal panel 45 is provided such that the first bottom panel 41 can be joined with the fourth bottom panel 44.

Since the blank 1 will be folded into the package 200, the blank 1 can be provided with crease lines, also referred to as folding lines or weakening lines, to provide for that the package 200 is folded as intended and with less of risk of packaging machine failure. As illustrated in FIG. 1A, a first vertical crease 61 can be provided between the first sidewall panel 11 and the front wall panel 12, a second vertical crease 62 can be provided between the front wall panel 12 and the third sidewall panel 13, a third vertical crease 63 can be provided between the third sidewall panel 13 and the rear wall panel 14, and a fourth vertical crease 64 can be provided between the rear wall panel 14 and the sidewall seal panel 15.

Further, to facilitate folding of the bottom panels 41-44 with respect to the first sidewall panel 11, the front wall panel 12, the second sidewall panel 13 and the rear wall panel 14, a bottom crease 71 may be provided. For folding the bottom 206, inclined creases are provided on two of the bottom panels 42, 44.

To facilitate folding the top of the package, a top crease 72 is provided between the first sidewall panel 11, the front wall panel 12, the second sidewall panel 13 and the rear wall panel 14, and the first top panel 21, the first gable panel 22, the second top panel 23 and the second gable panel 24. Further, a fin crease 73 is provided between the first top panel 21, the first gable panel 22, the second top panel 23 and the second gable panel 24, and the first top fin panel 31, the first gable fin panel 32, the second top fin panel 33 and the second gable fin panel 34.

To facilitate opening of the package, more particularly forming of a spout 203, as illustrated in FIGS. 2A and 2B, a first opening crease 81 may be provided on the first top panel 21, a first and a second spout crease 82, 83 may be provided on the first gable panel 22, and a second opening crease 84 may be provided on the second top panel 23.

Further, a spout center crease 91 is provided vertically on the first gable fin panel 32, and a spout top crease 92 may be provided horizontally on the first gable fin panel 32.

Further, a spout top center crease 93 may be placed vertically on the first gable fin panel 32, aligned with the spout center crease 91. The spout top center crease 93 may be placed in a peripheral vertical end of the front gable top panel 32.

More in detail, the first top panel 21 can comprise a first top section 211 and a first spout side rear section 212. As illustrated, the two sections can be divided by the first opening crease 81. To form the spout 203 the first opening crease 81 can be inclined approximately 45 degrees and extend in a direction from an intersection point of the first top panel 21, the first gable panel 22, the first sidewall panel 11 and the front wall panel 12 towards a mid-point of the first top fin panel 31. During forming of the spout 203, the first spout side rear section 212 can be folded onto the first top panel 21.

The first gable panel 22 can comprise a center spout center section 221, a first spout side front section 222 and a second spout side front section 223. The first spout side front section 222 can be placed next to the first spout side rear section 212 of the first top panel 21, divided by the first vertical crease 61. The first spout crease 82 can be placed such that the first spout side front section 222 and the spout center section 221 is divided. The first spout crease 82 can be inclined approximately 45 degrees and it can extend in a direction from the same intersection point as the first opening crease 81 and towards a mid-point of the first gable fin panel 32. On the other side, the spout center section 221 and the second spout side front section 223 can be divided by the second spout crease 83. The second spout crease 83 can mirror the first spout crease 82. In other words, it can be inclined approximately 45 degrees and it may extend from an intersection point of the first gable panel 22, the second top panel 23, the front wall panel 12 and the second sidewall panel 13, to the mid-point of the first gable fin panel 32.

In a corresponding manner as the first top panel 21, the second top panel 23 may comprise a second top section 231 and a second spout side rear section 232. The second top section 231 and the second spout side rear section 232 can be divided by the second opening crease 84. The second opening crease 84 can be inclined approximately 45 degrees and extend in a direction from the same intersection point as the second spout crease 83 and towards a mid-point of the second top fin panel 33.

As illustrated, to facilitate folding of the spout 203, the first opening crease 81 may be placed off-set such that the first opening crease 81 does not meet the first spout crease 82 in said intersection point. By having an off-set in this way, it has namely been found that the folding of a multi-layer packaging material, illustrated by way of example in FIG. 3, can be made with less risk of negatively affect the packaging integrity caused for instance by cracks in folding areas. For the same reason, the second opening crease 84 may be off-set in a similar manner.

As illustrated, the first opening crease 81 may also be offset with respect to the mid-point of the first top fin panel 31. The same holds true for the second opening crease 84 which may be offset with respect to the mid-point of the second top fin panel 33. By having off-sets in this way, folding in and folding out the spout 203 can be facilitated when using the multi-layer packaging material.

Figure 5:
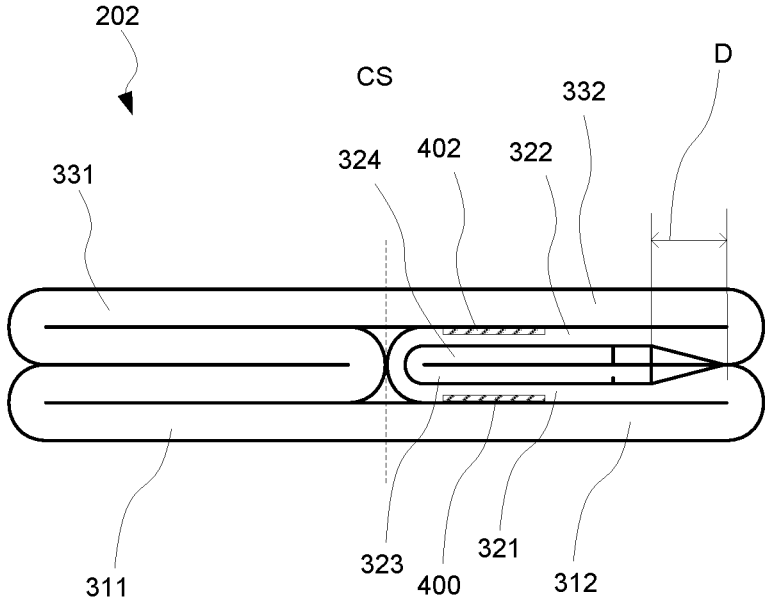
FIG. 5 is a schematic top view of a top fin of the package in a closed state.

In the closed state CS, see FIG. 5, the spout center section 221 can be folded inwards such that the first spout side front section 222 is facing in opposite direction compared to the direction the first spout side rear section 212 is facing. In a similar manner, in the closed state CS, the second spout side front section 223 can be facing in opposite direction compared to the direction a second spout side rear section 232 on the second top panel 23 is facing. In addition to the second spout rear section 232, the second top panel 23 may comprise a second top section 231, which may, in the same manner as the first top section 211 of the first top panel 21, be arranged to be in the same position in both the closed state CS and the opened state OS.

As illustrated, the first top fin panel 31 can be divided into a first top fin rear section 311 and a first top fin front section 312. In the opened state OS, the first top fin front section 312 can form a first top rear part of the spout 203 as illustrated in FIG. 2A.

The first gable fin panel 32 can be divided into a first spout section 321, placed vertically above the first spout side front section 222, and a second spout top section 322 placed vertically above the second spout side front section 223. The first and second spout top sections 321, 322 can be divided by the spout center crease 91.

Figure 1B:
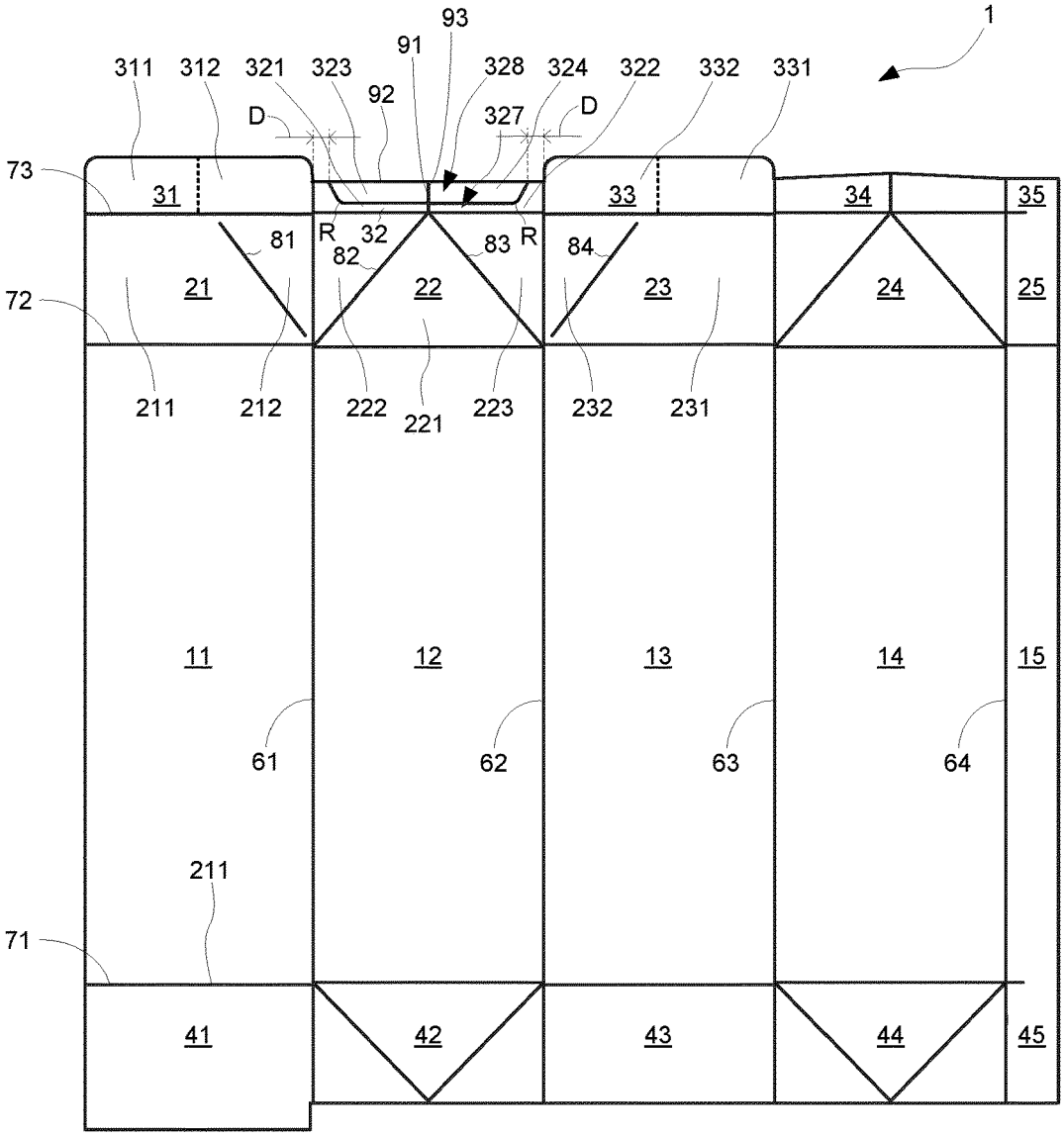
FIG. 1B illustrates the blank with the spout reinforcement section folded down.

The first gable fin panel 32 comprises the spout top crease 92, which separates the first gable fin panel 32 into a spout top portion 327 and a spout reinforcement portion 328 that is configured to be folded, along the spout top crease 92, over the spout top portion 327, as shown in FIG. 1B. The spout reinforcement portion 328 has a first spout reinforcement section 323 and a second spout top section 322 that are separated by the top center crease 93.

The first spout reinforcement section 323 is placed vertically above the first spout top section 321. In a similar manner, vertically above the second spout top section 322, the second spout reinforcement section 324 is placed. The first spout top section 321 and the second spout reinforcement section 323 as well as the second spout top section 322 and the second spout reinforcement section 324 can be divided by the spout top crease 92. The first and second reinforcement section 323, 324 can be divided by the spout top center crease 93. The first and second spout top section 321, 322 can together form the spout top portion 327, and the first and second reinforcement section 323, 324 can together form the spout reinforcement portion 328.

Similar to the first top fin panel 31, the second top fin panel 33 can be divided into a second top fin rear section 331 and a second top fin front section 332. In the opened state OS, the second top fin front section 332 can form a second top rear part of the spout 203 as illustrated in FIG. 2A.

A first inclined side 338 of the first spout reinforcement section 323 and a second inclined side 340 of the second spout reinforcement section 324 may be provided. The first inclined side 338 can face the first top front section 312, and the second inclined side 340 can face the second top fin front section 332. An advantage with having these inclined surfaces is that a risk of cracks or stress formed in the packaging material the blank 1 is made of when folding the first top fin panel 31 and the first gable fin panel 32, and also the second top fin panel 33 and the first gable fin panel 32, can be reduced, which is an effect of that there is fewer layers of packaging material close to the first and second vertical crease 61, 62, respectively.

The first and second spout reinforcement section 323, 324 may be placed a distance D from the first and second top fin front section 312, 332, respectively. This provides also for that forming of the top fin 202 of the package 200, illustrated in FIGS. 2A and 2B, can be made with less risk of causing cracks or stress in the packaging material 300 the blank 1 is made of, illustrated in FIG. 3.

FIG. 1B illustrates the blank 1 illustrated in FIG. 1A, but in FIG. 1B the spout reinforcement portion 328 is folded, along the spout top crease 92, over and on the spout top portion 327. The spout reinforcement portion 328 may have rounded corners R1, R2 that are located at opposite ends of the spout reinforcement portion 328. The rounded corners R1, R2 face a respective one of the first and second top fin front sections 312, 332.

Figure 7:
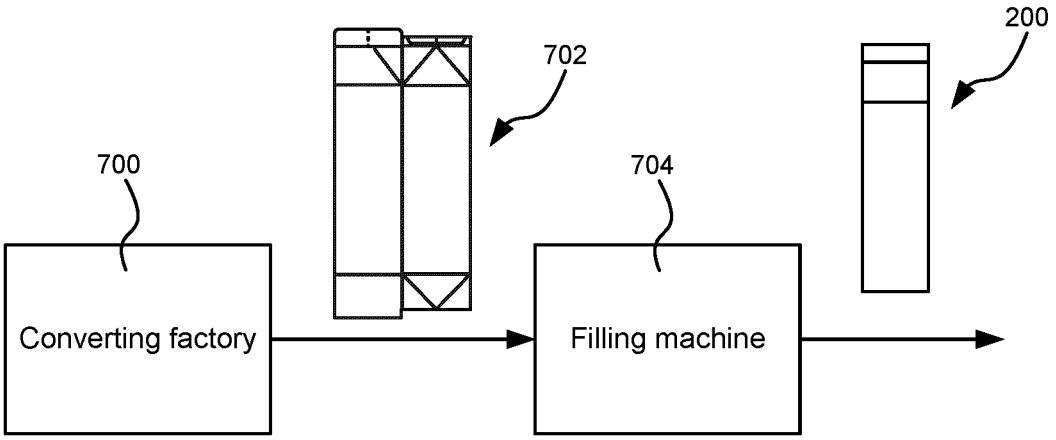
FIG. 7 schematically illustrates a converting factory producing pre-welded blanks and a filling machine for producing packages from the pre-welded blanks.

In addition to being folded onto the spout top portion 327, the spout reinforcement section 328 may be welded to the spout top portion 327. This folding and optionally welding may be made before shipping the blank 1 to a filling machine 704, as illustrated in FIG. 7, in which the blank 1 is transformed into the package 200, illustrated in FIGS. 2A and 2B, filled with liquid food product. As an alternative, the folding and optionally welding can be made in the filling machine 704, that is, the blank 1 is shipped as illustrated in FIG. 1A to the filling machine. Even though not illustrated in FIG. 1B, before shipping the blank 1 to the filling machine 704, a longitudinal sealing may be formed such that for instance the first sidewall panel 11 is joined with the rear wall panel 14.

Figure 1C:
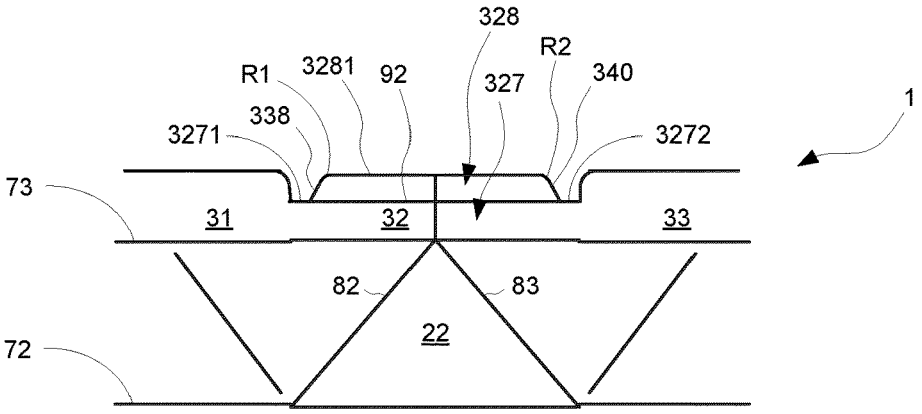
FIG. 1C is an enlarged view of a spout reinforcement portion of the blank of FIG. 1A.

With further reference to FIG. 1C, the spout reinforcement portion 328 may comprise an upper end side 3281 that is parallel to the spout top crease 92.

The upper end side 3281 may consist of a straight end side. In this context, consists of a straight end side means that the entire end side is straight, i.e. it has no protrusion, indentation or curved portion.

The spout reinforcement portion 328 may have an outer boundary that consists of, in consecutive order, the spout top crease 92, the first inclined side 338 of the two inclined sides 338, 340, a first rounded corner R1, the upper end side 3281 which may consist of a straight end side, a second rounded corner R2, and the second inclined side 340 of the two inclined sides 338, 340, which joins the spout top crease 92 to close the outer boundary of the spout reinforcement portion 328. In this context, "consists of" shall be understood as the outer boundary of the reinforcement portion 328 not having any other shapes than those described, i.e. the spout top crease 92, the inclined sides 338, 340 the rounded corners R1, R2 and the upper end side 3281. The spout top crease 92, the inclined sides 338, 340 the rounded corners R1, R2 and the upper end side 3281 may still incorporate all embodiments and features that are described for these elements.

The upper end side 3281 may be parallel to and shorter than the spout top crease 92, such that the inclined sides 338, 340, which may consist of a respective straight side, are inclined inwardly towards the upper end side 3281 of the reinforcement portion 328.

The spout top portion 327 may comprise two straight edge sections 3271, 3272 that extend in parallel to the spout top crease 92, from a respective end of the top spout crease 92 and towards the respective first and second top fin panels 31, 33. Each of the two straight edge sections 3271, 3272 may have a length D (see FIGS. 1A and 1B) that is at least 30% of a height H-RS (see FIG. 4) of the spout reinforcement portion 328. Having such length is advantageous in that it will be easier for making room to fold and form the top fin 202, even though the spout reinforcement portion 328 makes the total folded material thicker.

FIG. 2A illustrates a perspective view of the gable top package 200 in the opened state OS by way of example, when the blank 1 has been folded to form the package 200. FIG. 2B illustrates the package 200 from a side view. As illustrated, the first top fin front section 312 and the second top fin front section 332, as illustrated in FIGS. 1A and 1B, have been separated in the front end of the top fin 202, thereby allowing the first spout top section 321 and the second spout top section 322, also illustrated in FIGS. 1A and 1B, to be folded out such that the spout 203 can be formed.

The first sidewall panel 11, the front wall panel 12, the second sidewall panel 13 and the rear wall panel 14 and sidewall seal panel 15, illustrated in FIGS. 1A and 1B, have been folded and welded into a sleeve-shaped body 204. The first bottom panel 41, the second bottom panel 42, the third bottom panel 43, the fourth bottom panel 44 and the bottom seal panel 45 have been folded and welded into a bottom 206.

As illustrated, a top portion 205 of the spout 203 is provided with the spout reinforcement portion 328. Having the spout reinforcement portion 328 provided on the spout 203 comes with a number of advantages. First, by having this flap, i.e. the spout reinforcement portion 328 folded down, contact between a raw edge of the packaging material 300, further illustrated in FIG. 3, and the liquid food product can be avoided. In case, by way of example, the packaging material 300 comprises a layer of fibrous material 304, such as a carton layer, placed between an inner plastic layer 302 and an outer plastic layer 306, contact between the layer of fibrous material 304 and the liquid food product can be avoided when the liquid food product is poured out from the package 200. Second, the reinforcement portion 328 can provide increased robustness to the spout 203. Put differently, the double-layered top portion 205, formed when folding down the spout reinforcement section 328 onto the spout top portion 327, has the positive effect that a more distinctly shaped top portion 205 of the spout 203 can be formed compared to the single-layered top portion commonly used today. Having the double-layered top section 205 also provides for that thinner packaging material can be used compared to the packaging materials used today when having a single-layer top portion, which can have economical as well as environmental benefits. The packaging material 300 is only one example of packaging material that can be used for the blank, for allowing the blank to be folded and welded to form a gable top package. Any package material commonly used for gable top packages for the food industry may be employed.

Figure 3:
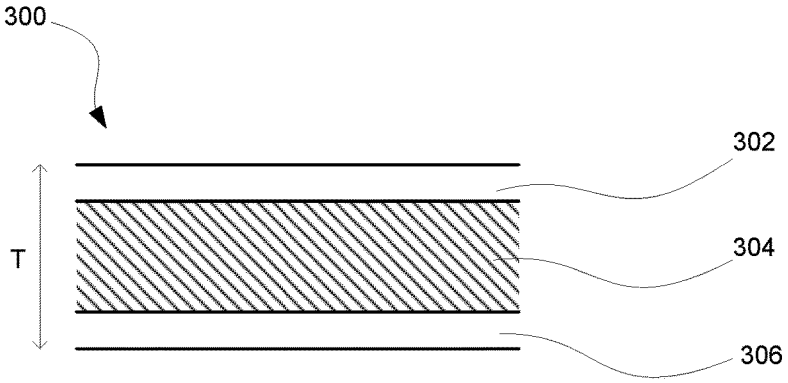
FIG. 3 is a cross-sectional view of a multi-layer packaging material.

FIG. 3 illustrates the packaging material 300 having a thickness T by way of example. To provide robustness and rigidity, the layer of fibrous material 304 is used. As described, to avoid contact between the layer of fibrous material 304 and the liquid food product held inside the package 200, an inner plastic layer 302 can be provided. On the other side of the layer of fibrous material 304, an outer plastic layer 306 can be provided. The outer plastic layer 306 may provide for that the layer of fibrous material 304 can be protected from the outside environment. The outer plastic layer 306 may also fulfil the purpose of protecting print provided on the layer of fibrous material 304.

To provide for that the risk of cracks in the packaging material 300 can be reduced, the distance D, illustrated in FIGS. 1A and 1B, can be at least three times the thickness T of the packaging material 300.

Figure 4:
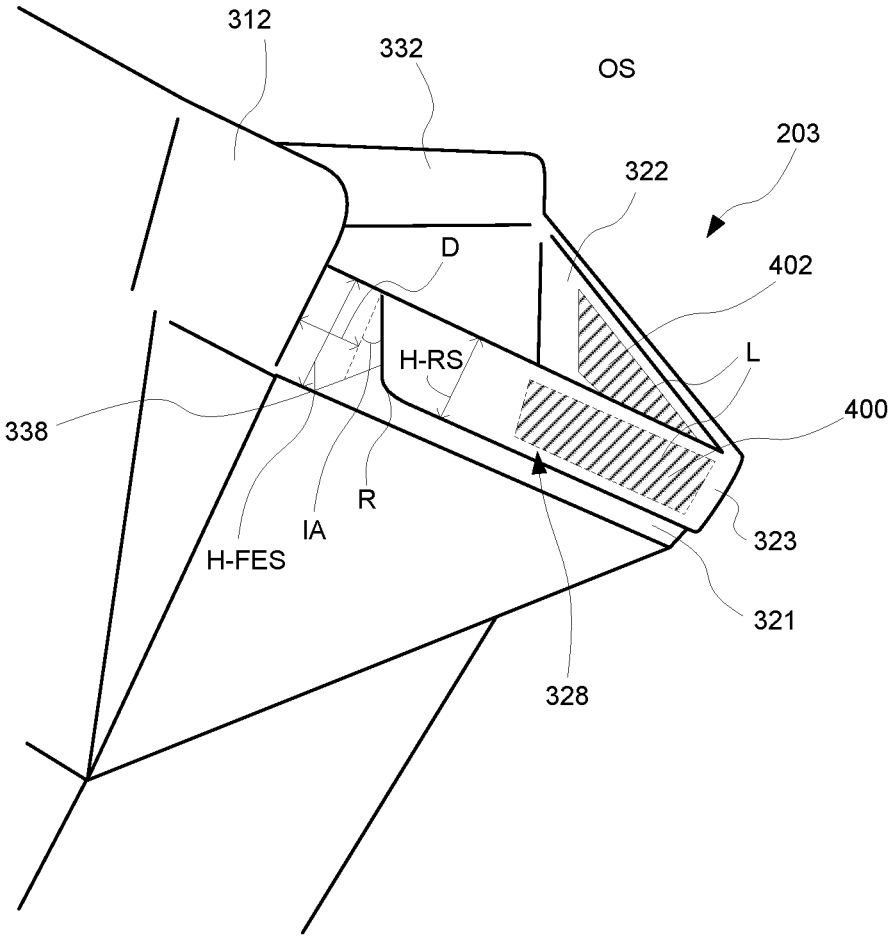
FIG. 4 is a detailed view of a spout of the gable top package.

FIG. 4 illustrates the spout 203 in further detail. As illustrated, the first inclined side 338 of the first spout reinforcement section 323 may be inclined, as seen relative the spout top crease 92, with an inclination angle IA, which may be 20 to 60 degrees. Further, as illustrated, a height H-RS of the spout reinforcement portion 328 may be within the range of 60-85% of a height H-FES of the spout top portion 327.

To avoid adherence between an inside of the spout during forming of the top fin 202, a first and second surface 400, 402 may be provided with lacquer L. By having this lacquer L, the heat used during the forming of the top fin 202, often referred to as transversal sealing, can be increased without risking adherence between the sections to be used for forming the spout 203.

FIG. 5 schematically illustrates the top fin 202 from above in further detail when in a closed state CS. As illustrated, by having the distance D, the additional packaging material 300 formed by the first and second spout reinforcement sections 323, 324 is moved away from the front end of the top fin 202, and by doing so reducing the risk for unwanted cracks or stress in the packaging material 300.

Figure 6:
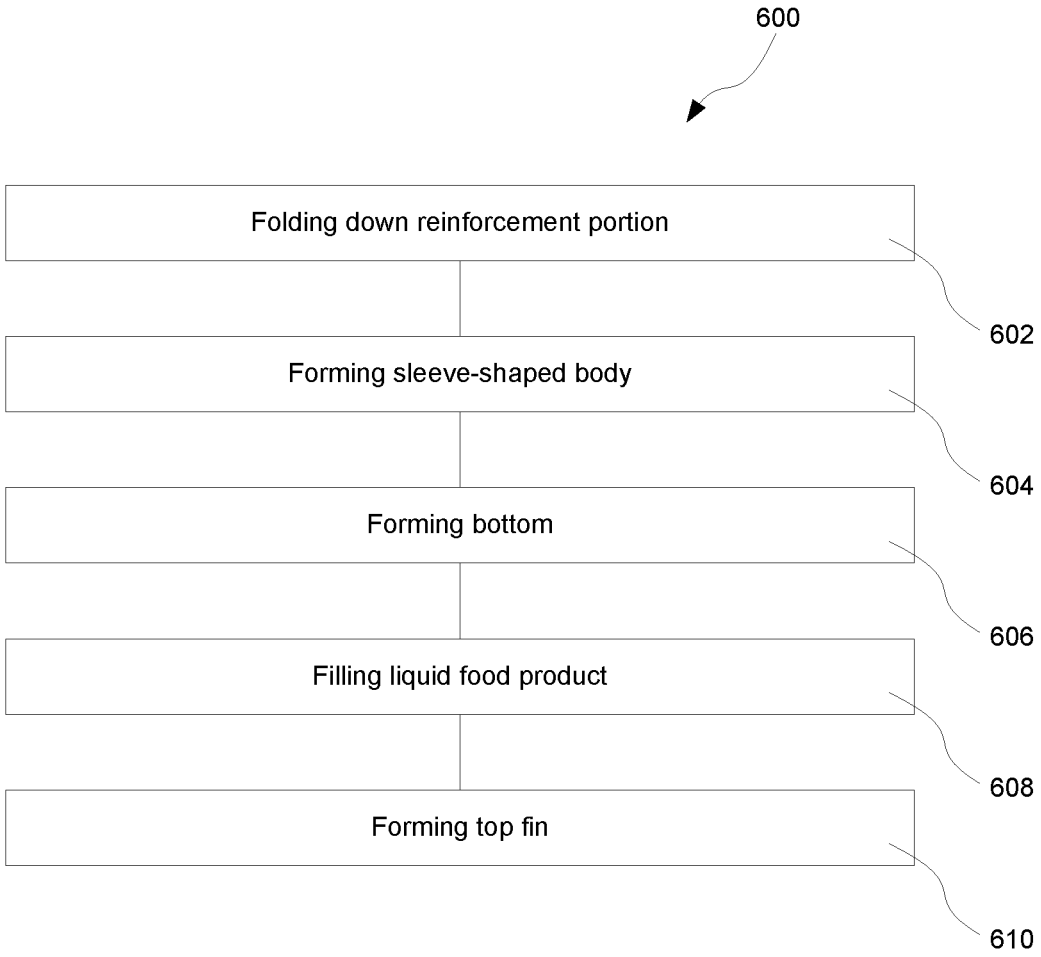
FIG. 6 is a flowchart illustrating the steps of a method for forming the gable top package from the blank.

FIG. 6 is a flowchart illustrating a method 600 for producing the carton gable top package 200 from the blank 1 as described above. The method 600 comprises a first step that includes folding down 602, along the spout top crease 92, the spout reinforcement portion 328 over the spout top portion 327. Thereafter, in a second step the sleeve-shape body 204 is formed 604 by welding a sidewall seal panel 15 of the blank 1 to the first sidewall panel 11 of the blank 1. In a third step the bottom 206 is formed 606 by welding the bottom panels 41-45 of the blank 1, such that the blank 1 forms a container. In a fourth step food product is filled 608 into the container. In a fifth step a top fin 202 is formed 610 by welding the first top fin panel 31 to the second top fin panel 33, for closing the container and form the carton gable top package 200.

Even though illustrated and described in a certain order, other orders may also be used. For instance, the first and second steps 602, 604 may be made in parallel or the second step 604 may be performed before the first step 602.

With reference to FIG. 7, to reduce complexity of the filling machine 704, so-called pre-welded blanks 702 can be used. By using this approach, part of the folding and welding may be made in a converting factory 700 instead of in the filling machine 704, sometimes also referred to as packaging machine. For instance, the longitudinal sealing may be made in the converting factory 700 such that the pre-welded blank 702 can be shipped to the filling machine 704 with the first sidewall panel 11 and the rear wall panel 14 joined before the pre-welded blank 702 is fed into the filling machine 704.

In addition to or as an alternative to making the longitudinal sealing in the converting factory 700, folding the spout reinforcement portion 328 over the spout top portion 327 may be made in the converting factory 700 such that the filling machine 704 does not need to be upgraded to perform this step. In addition, the converting factory 700 may also, in addition to folding, be arranged to weld the spout reinforcement portion 328 to the spout top portion 327.

Figure 8:
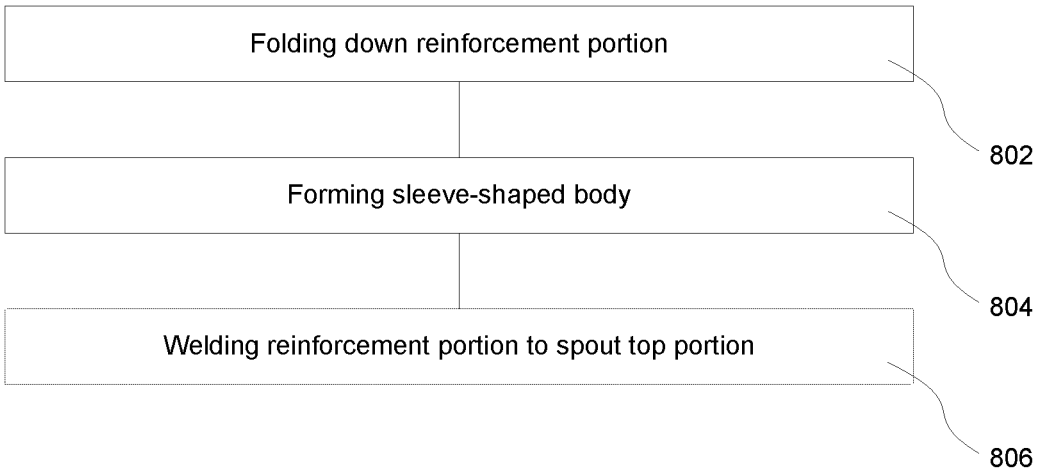
FIG. 8 is a flowchart illustrating the steps of a method for producing pre-welded blanks.

If using the approach described above and illustrated in FIG. 7, a method 800 illustrated by way of a flowchart in FIG. 8 can be used. More particularly, the method 800 can be used for producing the pre-welded blank 702 from the blank 1 such that the pre-welded blank 702 can be formed into a carton gable top package 200 in the filling machine 704. In a first step 802, the spout reinforcement portion 328 is folded 802 over the spout top portion 327. In a second step 804, the sleeve-shape body 204 can be formed by welding a sidewall seal panel 15 to the first sidewall panel 11.

Optionally, in a third step 806, the spout reinforcement portion 328 is welded 802 to the spout top portion 327.

From the description above follows that, although various embodiments of the invention have been described and shown, the invention is not restricted thereto, but may also be embodied in other ways within the scope of the subject-matter defined in the following claims.

The invention claimed is:

1. A blank configured to be folded into a gable top package that holds a food product and is openable by forming a spout for the package, the blank being formed from a multilayer packaging material that comprises a layer of fibrous material, and comprising bottom panels, sidewall panels, first and second top panels, first and second gable panels, first and second top fin panels and first and second gable fin panels, the first gable fin panel being located between the first and second top fin panels and arranged to form a top section of the spout for the folded gable top package, wherein the first gable fin panel comprises a spout top crease that separates the first gable fin panel into a spout top portion and a spout reinforcement portion that is configured to be folded, along the spout top crease, over the spout top portion, the spout reinforcement portion is arranged with a distance from the respective first and second top fin panels, and the spout reinforcement portion extends along a majority of the spout top portion, wherein the distance is greater than three times the thickness of the multilayer packaging material the blank is formed from.

2. The blank according to claim 1, wherein the spout reinforcement portion comprises first and second inclined sides that are located at opposite ends of the spout reinforcement portion, the first inclined side faces the first top fin front section, the second inclined side faces the second top fin front section, and the inclined sides are inclined relative a direction that is parallel to crease lines of the blank that separate the sidewall panels from each other.

3. The blank according to claim 2, wherein the first and second inclined sides are inclined, as seen relative the spout top crease, with an inclination angle that is within the range of 20 to 60 degrees.

4. The blank according to claim 2, wherein the spout reinforcement portion has an outer boundary that consists of, in consecutive order, the spout top crease, the first inclined side of the two inclined sides, a first rounded corner, the upper end side which consists of a straight end side, a second rounded corner, and the second inclined side of the two inclined sides, which joins the spout top crease to close the outer boundary of the spout reinforcement portion.

5. The blank according to claim 4, wherein the upper end side is parallel to and shorter than the spout top crease, such that the inclined sides, which consist of a respective straight side, are inclined inwardly towards the upper end side of the reinforcement portion.

6. The blank according to claim 1, wherein the spout reinforcement portion comprises an upper end side that is parallel to the spout top crease, and the upper end side consists of a straight end side.

7. The blank according to claim 1, wherein the spout top portion comprises two straight edge sections that extend in parallel to the spout top crease, from a respective end of the top spout crease towards the respective first and second top fin panels, and each of the two straight edge sections has a length that is at least 30% of a height of the spout reinforcement portion.

8. The blank according to claim 1, wherein the spout reinforcement portion comprises rounded corners that are located at opposite ends of the spout reinforcement portion, wherein the rounded corners face a respective one of the first and second top fin front sections.

9. The blank according to claim 1, wherein a height of the spout reinforcement portion is within the range of 60-85% of a height of the spout top portion.

10. The blank according to claim 1, wherein the spout reinforcement portion is welded to the spout top portion.

11. The blank according to claim 1, wherein the spout reinforcement portion is provided with a lacquer.

12. A carton gable top package produced from the blank according to claim 1.

13. A method for producing a carton gable top package from a blank according to claim 1, the method comprising folding down, along the spout top crease, the spout reinforcement portion over the spout top portion, forming a sleeve-shape body by welding a sidewall seal panel of the blank to a first sidewall panel of the blank, forming a bottom by welding bottom panels of the blank, such that the blank forms a container, filling food product into the container, and forming a top fin by welding the first top fin panel to the second top fin panel while the spout reinforcement portion is folded over the spout top portion, for closing the container and form the carton gable top package.

14. A blank configured to be folded into a gable top package that holds a food product and is openable by forming a spout for the package, the blank being formed from a multilayer packaging material that comprises a layer of fibrous material, and comprising bottom panels, sidewall panels, first and second top panels, first and second gable panels, first and second top fin panels and first and second gable fin panels, the first gable fin panel being located between the first and second top fin panels and arranged to form a top section of the spout for the folded gable top package, wherein the first gable fin panel comprises a spout top crease that separates the first gable fin panel into a spout top portion and a spout reinforcement portion that is configured to be folded, along the spout top crease, over the spout top portion, the spout reinforcement portion is arranged with a distance from the respective first and second top fin panels, the spout reinforcement portion comprises first and second inclined sides that are located at opposite ends of the spout reinforcement portion, the first inclined side faces the first top fin front section, the second inclined side faces the second top fin front section, the inclined sides are inclined relative a direction that is parallel to crease lines of the blank that separate the sidewall panels from each other, the spout reinforcement portion comprises an upper end side that is parallel to the spout top crease, and the upper end side consists of a straight end side, the spout reinforcement portion has an outer boundary that consists of, in consecutive order, the spout top crease, the first inclined side of the two inclined sides, a first rounded corner, the upper end side which consists of a straight end side, a second rounded corner, and the second inclined side of the two inclined sides, which joins the spout top crease to close the outer boundary of the spout reinforcement portion, the upper end side is parallel to and shorter than the spout top crease, such that the inclined sides, which consist of a respective straight side, are inclined inwardly towards the upper end side of the reinforcement portion, the spout top portion comprises two straight edge sections that extend in parallel to the spout top crease, from a respective end of the top spout crease towards the respective first and second top fin panels, and each of the two straight edge sections has a length that is at least 30% of a height of the spout reinforcement portion.

15. A blank configured to be folded into a gable top package that holds a food product and is openable by forming a spout for the package, the blank being formed from a multilayer packaging material that comprises a layer of fibrous material, and comprising bottom panels, sidewall panels, first and second top panels, first and second gable panels, first and second top fin panels and first and second gable fin panels, the first gable fin panel being located between the first and second top fin panels and arranged to form a top section of the spout for the folded gable top package, wherein the first gable fin panel comprises a spout top crease that separates the first gable fin panel into a spout top portion and a spout reinforcement portion that is configured to be folded, along the spout top crease, over the spout top portion, the spout reinforcement portion is arranged with a distance from the respective first and second top fin panels, and the spout reinforcement portion extends along a majority of the spout top portion, wherein the spout reinforcement portion comprises rounded corners that are located at opposite ends of the spout reinforcement portion, wherein the rounded corners face a respective one of the first and second top fin front sections.

* * * * *